United States Patent [19]

Bing et al.

[11] 4,199,706

[45] Apr. 22, 1980

[54] SPRING-LOADED RESISTOR TERMINAL

[75] Inventors: Valentijn B. Bing, Des Plaines; Donald A. Neis, Naperville, both of Ill.

[73] Assignee: Zenith Radio Corporation, Glenview, Ill.

[21] Appl. No.: 830,270

[22] Filed: Sep. 2, 1977

[51] Int. Cl.[2] ..... H01J 29/84; H01J 31/00; H01H 37/08

[52] U.S. Cl. ..... 313/481; 338/329; 338/332

[58] Field of Search ..... 338/329, 332, 322; 313/481

[56] References Cited

U.S. PATENT DOCUMENTS

| | | | |
|---|---|---|---|
| 1,824,447 | 9/1931 | Richter | 338/332 X |
| 3,319,210 | 5/1967 | Sandone et al. | 338/322 |
| 3,504,228 | 3/1970 | Morris | 338/332 X |
| 3,573,422 | 4/1971 | Langenbach et al. | 338/329 X |
| 4,101,803 | 7/1978 | Retsky et al. | 313/477 R X |

FOREIGN PATENT DOCUMENTS

| | | | |
|---|---|---|---|
| 440762 | 1/1936 | United Kingdom | 338/332 |

*Primary Examiner*—Robert Segal
*Attorney, Agent, or Firm*—John H. Coult

[57] ABSTRACT

This disclosure depicts structure and method for terminating an electrical resistor for a television CRT which could be used for arc suppression, voltage division or the like. The structure is disclosed in a preferred form as comprising a cylindrical rod of predetermined length, diameter and resistance. On at least one end of the rod, an electrically conductive coil spring is constricted in firm electrical and mechanical connection with said rod. At least a number of the turns of the spring are mechanically joined to prevent the spring from being torsionally stressed open so as to release the rod. Also disclosed is a method of making an electrical-mechanical termination.

1 Claim, 4 Drawing Figures

SPRING-LOADED RESISTOR TERMINAL

CROSS REFERENCE TO RELATED PATENT APPLICATION

This application is related to, but not dependent upon a number of copending applications of common ownership herewith, including: Ser. No. 708,817, filed July 26, 1976, Ser. No. 802,223, filed June 1, 1977 now U.S. Pat. No. 4,101,803, issued July 18, 1978, Ser. No. 803,907, filed June 6, 1977, now U.S. Pat. No. 4,153,857, issued May 8, 1979 Ser. No. 811,494, filed June 30, 1977, now U.S. Pat. No. 4,161,673, filed July 17, 1979, all assigned to Zenith Radio Corporation.

BACKGROUND OF THE INVENTION

This application relates to discrete electrical resistors for television cathode ray tubes (CRTs) and in preferred forms to resistors supported on television CRT electron guns for arc suppression, voltage division or the like. Particularizing further, this invention relates to improved structure for terminating such electrical resistors.

Discrete resistors have been used on television CRT electron guns for a number of purposes, including arc suppression and voltage division. It has been found that a discrete electrical resistor for use in voltage division or arc suppression preferably takes an elongate form in order to minimize high voltage breakdown (in high voltage applications), to make possible the use of more practical resistor materials, to minimize heat generation within the resistor, and to maximize the stability of the resistor.

Problems associated with the use of discrete resistors for the named applications are those of how to mount and make electrical connection thereto. The mechanical integrity of the resistor support must be of high caliber to withstand mechanical jarring of the gun or containing tube. The mechanical support must be capable of withstanding handling during manufacture and assembly and the hostile conditions encountered during fabrication of a cathode ray tube.

The electrical connections made at the ends of the resistor must be sound and of low resistance. Such connections must not degrade during the processes encountered during fabrication of the gun and the containing cathode ray tube. The electrical connecting structure must not be such as to generate field concentrations on the terminal which might promote high voltage breakdown across the resistor or between the resistor and adjacent tube elements, nor otherwise be a factor leading to failure or degeneration of the performance or reliability of the gun or containing tube.

Yet another very important consideration is that the resistor terminating structure and the method by which the terminations are made be economical.

The prior art contains a number of disclosures of discrete electrical resistors for use in television CRTs, and in particular resistors which are mounted on television CRT guns. However these disclosures are for the most part schematic, and avoid the very real problems associated with the terminating of the resistors in a way which is practical and cost effective.

For example, U.S. Pat. No. 3,882,348-Paridaens shows an arc suppression resistor of the hollow cylinder type through which the electron beams are passed. At one end a sleeve 16 is welded to a plate 15 connected to the anodes of the electron guns. The sleeve is slid over the end of the cylindrical resistor and welded to a contact strip 21 with connection strips 24 and 25.

The Paridaens termination structure is not believed to be commercially feasible for a number of reasons. The integrity of the mechanical and electrical connection would be of questionable quality unless solder or some other similar connecting intermediary material were used. However, at the high temperatures encountered during tube fabrication, the solder would melt and escape. Further, the problems of the solder vaporizing and contaminating the gun cathodes is very real and rules out the use of this material. No suitable material to serve the solder function is known.

Gallaro et al, U.S. Pat. No. 3,295,008 discloses an arc suppression resistor which is interposed in a snubber spring on the anode of a cathode ray tube electron gun (see FIG. 4). Gallaro et al. surrounds his bulk mode resistor 57 with a ceramic or glass enclosure. Electrical contact is apparently made by extending the snubber spring components into the bulk mode material. This approach would be totally unsuitable for applications wherein a surface resistive coating is employed.

Still another approach is disclosed in British Pat. No. 1,448,223. That patent shows a cylindrical insulative core on which is disposed a helical resistive strip. Conductive end caps terminate the resistor. This approach suffers from the same drawbacks as the Paridaens approach.

U.S. Pat. No. 3,932,786-Campbell discloses a discrete voltage division resistor in the nature of a resistive strip printed on a ceramic substrate. The substrate is mounted on a glass pillar of the conventional type which supports the electrodes of an electron gun in spaced relationship. The Campbell resistor is terminated by conductors (54 and 56) which interconnect the ends of the resistor to appropriate electrodes in the gun. This approach would appear to have utility only where the glass pillar is used to support the resistor. The electrical integrity of the Campbell connections is not known.

It is known to terminate an electrical component by wrapping a conductive wire around an end thereof so as to make a terminal. However, such an approach to terminating an electrical resistor would not be useful in the applications contemplated for this invention for a number of reasons. The resultant coil would be biased to open, possibly degrading the mechanical and/or electrical interconnection. Further, wrapping process would be quite apt to destroy or damage the fragile elongate resistors to which this invention is applied.

Other Prior Art

U.S. Pat. No. 3,909,665-Grimmett et al
U.S. Pat. No. 3,267,321-Gessford, Sr.

OBJECTS OF THE INVENTION

It is an object of this invention to provide for use with a television cathode ray tube a discrete resistor for arc suppression, voltage division or the like, and in particular improved structure for terminating such a resistor.

It is another object of this invention to provide a discrete electrical resistor for use with television cathode ray tube electron guns which represents an improvement over the prior art in the soundness of the mechanical and electrical connections to the resistor.

It is an object of this invention to provide a discrete resistor of the type described which is low in cost.

It is yet another object of this invention to provide an electrical termination for a discrete resistor which does not produce intense field concentrations when assembled in a completed and operating tube.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

FIG. 1 is a sectioned side view of a portion of a color cathode ray tube embodying the present invention. Before discussing the present invention, however, certain tube components which comprise the environment for the present invention will be described.

Figures 1, 2, 3, 4:
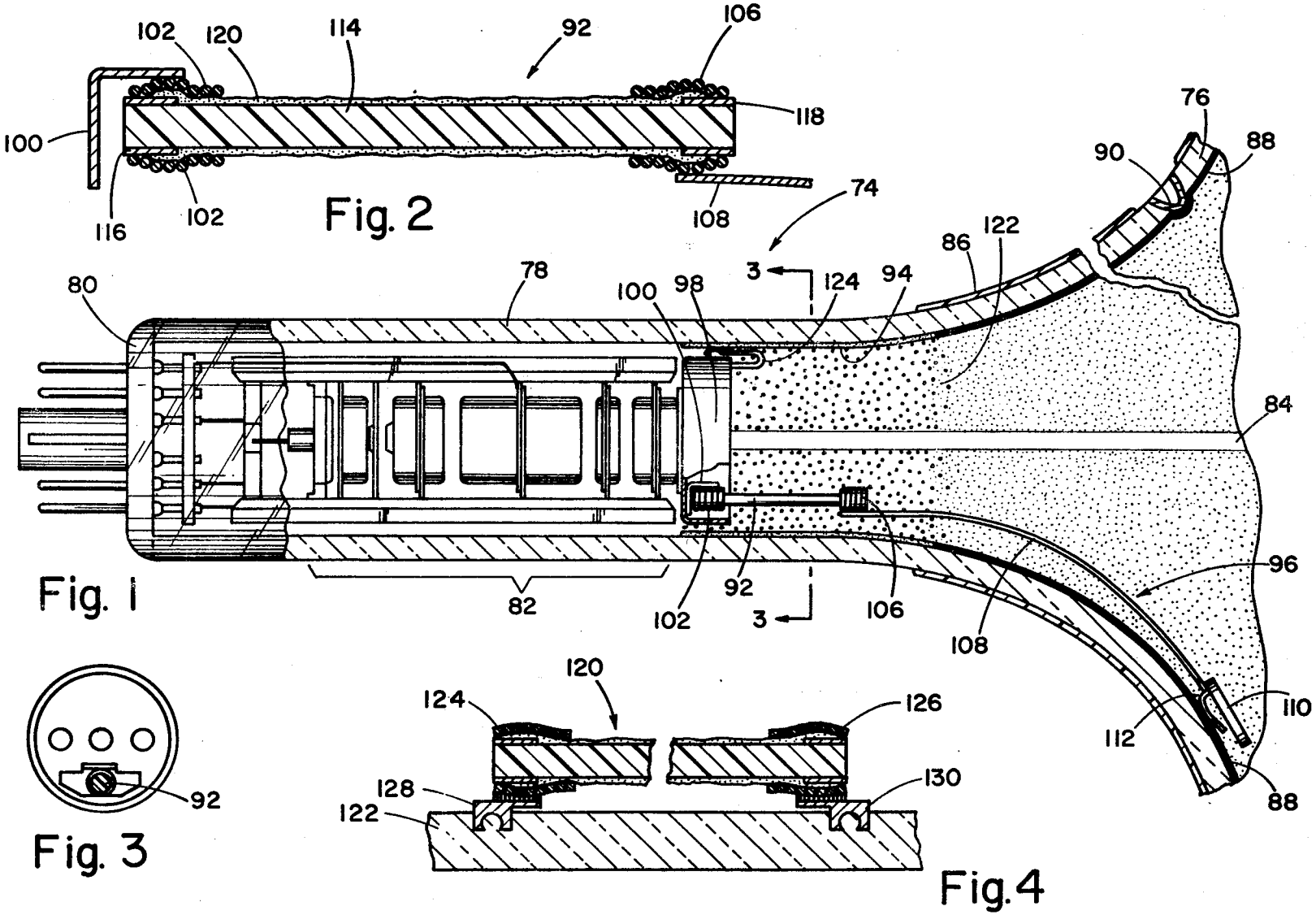
FIG. 1 is a sectional side view of a portion of a color cathode ray tube embodying the teachings of the present invention.
FIG. 2 is an enlarged view of a discrete arc suppression resistor shown in FIG. 1.
FIG. 3 is a section view taken along lines 3—3 in FIG. 1.
FIG. 4 depicts an alternative embodiment of the invention.

The FIG. 1 implementation of the present invention is shown as including a portion of a glass funnel 76 which blends into a neck 78. The neck 78 is terminated by a base 80 supporting a number of pins through which electrical communication is made between the television chassis and the interior of the tube 74.

In the neck of the tube is disposed an electron gun assembly 82 which generates one or more electron beams. In the illustrated embodiment the tube is a color cathode ray tube; the gun assembly 82 generates three coplanar beams which are shown edge-on at 84. The tube includes an outer conductive coating 86 which is maintained at ground potential and an inner conductive coating 88 which receives a high voltage from an exterior source (not shown) through an anode button 90. The inner and outer conductive coatings 86, 88 constitute a high voltage smoothing filter and may be conventional composition.

The tube 74 includes an anti-static coating 94 disposed on the inner surface of the tube in the region where the neck 78 blends into the funnel 76. The anti-static coating serves to drain off static charge falling on that region of the tube's inner surface. The anti-static coating 94 also cooperates with a discrete arc suppression resistor (to be described in detail hereinafter) to form a parallel arc suppression resistive network. The parallel network forms no part of this invention, per se, but is fully described and claimed in the referent U.S. Pat. No. 4,101,803 issued July 18, 1978.

The present invention concerns the provision of an improved discrete resistor for use in television cathode ray tube for arc suppression, internal voltage division, or the like and particularly concerns improved structure and method for terminating such a resistor. In the FIGS. 1–3 embodiment, the resistor 92 (including its terminations) represents an implementation of the teachings of the present invention.

Before engaging in a discussion of the nature and details of the present invention, an overview of the construction of the resistor 92 and the getter assembly of which it is a part will be given. The resistor 92 forms part of a getter assembly which includes a getter support or strap 108 on the end of which is a getter pan 110. The pan 110 is supported on runners 112 which make firm physical and electrical contact with the inner conductive coating 88. The pan may carry a quantity of conventional getter material—for example a gas-doped barium compound.

Should conditions be right for an arc to occur in the gun, for example, as a result of a foreign particle lodging in a narrow inter-electrode space in the gun assembly 82, an arc will propagate through the getter runner 112, support 108, arc suppression resistor 92, through the gun assembly 82 and associated gun drive circuitry to a ground within the associated receiver. As a result of the introduction of the arc suppression resistor 92 between the inner conductive coating 88 and the gun assembly 82, the magnitude of the arc current will be greatly suppressed, for example by an order of 100 to 1 or more. The particular elongate configuration of the resistor 92 and its incorporation in a getter assembly does not constitute an aspect of the present invention, per se, but rather is described and claimed in referent copending application Ser. No. 811,494.

In the illustrated preferred embodiment the resistor 92 is shown as comprising an insulative cylindrical rod 114 on the opposed ends of which are deposited conductive termination coatings 116, 118 of nickel, silver, iridium, or gold, for example, which assure good electrical contact with a high resistivity coating 120. The resistivity coating 120 overlaps the metal termination coatings 116, 118 in order to assure the integrity of the electrical connection therebetween.

The high resistivity coating is preferably composed of a resistive frit material such as that supplied by Corning Glass Works of Corning, N.Y. as Corning Glass Material No. 8464. Further it is desirable that a coating be caused to have an extremely irregularized topography to minimize the likelihood that it might be shorted out by conductive getter flash deposits when the getter is "flashed". The surface topopraphy irregularization may be accomplished by camphorating the resistive frit suspension, or by other means. The surface irregularization and its method of manufacture forms no part of this invention but is described and claimed in the referent copending application Ser. No. 803,907, filed June 6, 1977.

The present invention will now be described — first the novel termination structure and then the method of making same. In a general sense, the present invention concerns in one aspect the provision of a resistor for use with a television cathode ray tube for arc suppression, voltage division or the like. The resistor comprises a cylindrical rod of predetermined length, diameter and resistance. On one end of the rod an electrically conductive coil spring is constricted in firm electrical and mechanical connection with the rod. At least a number of the turns of the coil spring are mechanically joined to prevent the coil from being torsionally stressed open and releasing the rod.

In the preferred arc suppression resistor application shown in FIGS. 1–3, the resistor includes two electrically conductive coil springs 102, 106 constructed according to this invention. The coil springs have an inner diameter which is slightly less than the outer diameter of an insulative rod 114 on which they are mounted. The coil springs may be formed of Inconel, a metal which has an appropriate spring characteristic which is not significantly altered during the high temperature fabrication processes which a television cathode ray tube is subjected to. Inconel is compatible with the clean, high vacuum environment within a cathode ray tube.

The coil springs 102, 106 serve to provide a very sound mechanical and electrical connection with the ends of the rod 114. The springs 102, 106 are disposed so as to engird the respective one of the termination coatings 116, 118. The coil springs preferably also extend at least onto the region of overlap between the resistive coating 120 and the termination coating.

The springs 102, 106 have a number of advantages over other types of connectors which might be employed. First, because they are stressed-open coil springs, they very securely grasp an inserted end of a resistor rod when released. Thus a very firm and sound electrical and mechanical engagement is made with the resistive coating 120 and the adjacent termination coatings.

Due to the compliant nature of the springs 102, 106, the turns follow the step at the end of the high resistivity coating 120 where it overlaps the termination coating. The springs thus make good electrical contact with not only the metal termination coatings 116, 118 but also with the end of the high resistivity coating 120. Being a dry type of connection. the springs 102, 106 make a firm electrical and mechanical engagement with the coatings (or with a bulk mode resistor if such were used), without the need for solder or other intermediary connection medium which is apt to liquify and lose its mechanical and/or electrical integrity during the high temperature thermal process cycles which the tube must endure during its fabrication. Futther, the use of a dry type connector eliminates contamination and other problems attending the maintenance of a clean high vacuum environment in a CRT.

In the illustrated preferred embodiment the turns of each coil are joined so to lock the coils on the rod and thus prevent any possibility that the springs might be torsionally stressed open and thereby release the rod. In the illustrated preferred embodiments the junction of the coil spring turns is effected by affixation of an electrically conductive support element to turns of the spring. The electrically conductive support element serves not only to lock the springs on the rod, by affixation of the turns, but also serves as an electrical terminal and; as will be described, it may also serve to support the resistor on the gun.

In the FIGS. 1–3 embodiment, the support element at one end is illustrated in the form of a bracket 100 which is welded to the coil spring 102. The free end of the bracket 100 is welded to the anode electrode 98. The bracket 100 thus serves as an electrical terminal and as a mechanical support for one end of the resistor 92.

At the opposed end of the resistor, the support element takes the form of the getter strap 108. The getter strap 108 is electrically conductive and is affixed to the coil spring 106 preferably by welding.

The use of coil springs in accordance with this invention also has the advantages of low cost, and ability to withstand the high voltage arcing currents through the getter assembly. Further, the rounded nature of the coil spring does not produce a concentration of field lines at the ends of the resistor which might induce arcing across the resistor or between the resistor terminations and adjacent tube elements.

A method of making an electrical-mechanical termination for a cylindrical resistor will now be described. It is first necessary to provide an electrically conductive coil spring whose unstressed inside diameter is slightly less than the outside diameter of the resistor. The diameter of the spring is then enlarged by imposing a torsional stress thereon. This can be done by use of a suitable tool. An end of the resistor rod is then inserted into the open spring. The spring is released to permit it to tightly constrict upon the rod and thereby make a sound electrical and mechanical engagement with the rod. The spring is then locked in the resistor rod by permanently joining together a number of turns of the spring. As mentioned, this is preferably accomplished by affixing a support element such as a bracket or getter strap across a number of turns of the spring to prevent the spring from being opened and releasing the rod.

Changes and modifications may be made in the above-described structures and method without departing from the true spirit and scope of the invention herein involved. For example, as shown in FIG. 4, the teachings of this invention may be employed for mounting a discrete electrical resistor 120 onto a glass bead 122 of the type used to hold electron gun electrodes in spaced relationship. Such a resistor may be useful as part of a voltage divider for developing voltages for application to internal tube components.

The resistor 120 may be constructed substantially as illustrated in FIGS. 1–3 and described above. Two differences are depicted, however. In the FIG. 4 embodiment, by way of showing that other coil spring structures may be employed, the coil springs 124, 126 are shown as being made of wire having a square cross section, rather than having a circular cross section. Secondly, rather than utilizing a bracket and getter strap as the support elements for locking the coil springs on the resistor rod and for supporting the resistor, in the FIG. 4 embodiment the coil springs are welded to a pair of claw members 128, 130 which are embedded in the glass bead 122 according to conventional embedment structures and methods.

Still other changes may be made from the above-described apparatus and it is intended that the subject matter in the above depictions shall be interpreted as illustrative and not in a limiting sense.

What is claimed is:

1. An electron gun for a television cathode ray tube including a getter assembly incorporating an arc suppression resistor, said assembly comprising:

an elongate cylindrical rod of predetermined length, diameter and resistance, said rod comprising an insulative core having a conductive termination coating on each end, said core being covered by a resistive coating which overlaps a marginal portion of each of said termination coatings on each end of said rod;

on each end of said rod, an electrically conductive coil spring disposed on said termination coating and extending over said overlapped marginal portion thereof, said spring being constricted into firm electrical and mechanical connection with said rod and said coatings, an electrically conductive getter strap welded to one of said coil springs for supporting a getter pan on the distal end of said resistor and for serving as an electrical terminal therefor; and an electrically conductive bracket welded to the other of said coil springs for supporting said getter assembly on the gun and for serving as another electrical terminal therefor, said bracket and said strap mechanically joining a number of turns of the respectively attached coil spring to prevent said spring from being torsionally stressed open and thereby releasing said rod.

* * * * *